US005955250A

United States Patent [19]

Christian et al.

[11] Patent Number: 5,955,250

[45] Date of Patent: Sep. 21, 1999

[54] ELECTRICALLY-CONDUCTIVE OVERCOAT LAYER FOR PHOTOGRAPHIC ELEMENTS

[75] Inventors: Paul A. Christian, Pittsford; Mark Lelental, Rochester; Dennis J. Eichorst, Fairport, all of N.Y.

[73] Assignee: Eastman Kodak Company, Rochester, N.Y.

[21] Appl. No.: 08/991,288

[22] Filed: Dec. 16, 1997

[51] Int. Cl.[6] ..... G03C 1/85; G03C 1/89

[52] U.S. Cl. ..... 430/528; 430/527; 430/529; 430/530

[58] Field of Search ..... 430/527, 528, 430/529, 530

[56] References Cited

U.S. PATENT DOCUMENTS

| | | |
|---|---|---|
| 3,062,700 | 11/1962 | Dalton . |
| 3,082,123 | 3/1963 | Chu . |
| 3,201,251 | 8/1965 | Nadeau et al. . |
| 3,245,833 | 4/1966 | Trevoy . |
| 3,473,419 | 10/1969 | Ollearo . |
| 3,519,561 | 7/1970 | Kelly et al. . |
| 3,589,906 | 6/1971 | McDowell . |
| 3,625,695 | 12/1971 | Scudder et al. . |
| 3,666,478 | 5/1972 | Groh et al. . |
| 3,725,705 | 4/1973 | Borinski . |
| 3,754,924 | 8/1973 | De Geest et al. . |
| 3,775,236 | 11/1973 | Ambrose . |
| 3,850,642 | 11/1974 | Bailey, Jr. et al. . |
| 4,175,969 | 11/1979 | Mackey . |
| 4,275,103 | 6/1981 | Tsubusaki et al. . |
| 4,394,441 | 7/1983 | Kawaguchi et al. . |
| 4,416,963 | 11/1983 | Takimoto et al. . |
| 4,418,141 | 11/1983 | Kawaguchi et al. . |
| 4,431,764 | 2/1984 | Yoshizumi . |
| 4,495,276 | 1/1985 | Takimoto et al. . |
| 4,510,233 | 4/1985 | Yokoyama et al. . |
| 4,571,361 | 2/1986 | Kawaguchi et al. . |
| 4,649,102 | 3/1987 | Mukunoki et al. . |
| 4,891,307 | 1/1990 | Mukunoki et al. . |
| 4,999,276 | 3/1991 | Kuwabara et al. . |
| 5,122,445 | 6/1992 | Ishigaki . |
| 5,137,802 | 8/1992 | Ueda et al. . |
| 5,238,801 | 8/1993 | Ishigaki et al. . |
| 5,254,448 | 10/1993 | Yamada et al. . |
| 5,288,598 | 2/1994 | Sterman et al. . |
| 5,294,525 | 3/1994 | Yamauchi et al. . |
| 5,368,894 | 11/1994 | Lammers et al. . |
| 5,368,995 | 11/1994 | Christian et al. . |
| 5,378,577 | 1/1995 | Smith et al. . |
| 5,382,494 | 1/1995 | Kudo et al. . |
| 5,459,021 | 10/1995 | Ito et al. . |
| 5,582,959 | 12/1996 | Ito . |
| 5,719,016 | 2/1998 | Christian et al. ..... 430/530 |
| 5,731,119 | 3/1998 | Eichorst et al. ..... 430/530 |

*Primary Examiner*—Richard L. Schilling
*Attorney, Agent, or Firm*—Carl F. Ruoff

[57] ABSTRACT

The present invention is a multilayer imaging element which includes a support, one or more image-forming layers superposed on the support, and an outermost transparent electrically-conductive, non-charging, overcoat layer superposed on the support. The over coat layer is colloidal, acicular electrically-conductive metal-containing particles, dispersed in a film-forming binder at a volume percentage of acicular conductive metal-containing particles of from 2 to 60. The overcoat layer further includes a first charge control agent which imparts positive charging properties and a second charge control agent which imparts negative charging properties.

15 Claims, 3 Drawing Sheets

ELECTRICALLY-CONDUCTIVE OVERCOAT LAYER FOR PHOTOGRAPHIC ELEMENTS

CROSS REFERENCE TO RELATED APPLICATIONS

This application relates to commonly assigned copending application Ser. No. 08/991,493, filed simultaneously herewith and hereby incorporated by reference for all that it discloses.

FIELD OF THE INVENTION

This invention relates generally to imaging elements comprising a support, subbing layers, one or more image forming layers, and one or more electrically conductive layers. More specifically, this invention relates to improved imaging elements comprising electrically-conductive surface protective (overcoat) layer(s) overlying the image-forming layer(s) including colloidal, electronically-conductive acicular metal-containing particles, a first charge control agent which imparts positive charging and a second charge control agent which imparts negative charging and a polymeric film-forming binder.

BACKGROUND OF THE INVENTION

Problems associated with the generation and discharge of electrostatic charge during the manufacture and use of photographic film and paper products have been recognized for many years by the photographic industry. The accumulation of static charge on film or paper surfaces can cause irregular static marking or fog patterns in the emulsion layer(s). The presence of static charge can lead to difficulties in support conveyance as well as to dust attraction, which can result in fog, desensitization, and other physical defects during emulsion coating. The discharge of accumulated static charge during or after the application of the sensitized emulsion layer(s) can produce irregular fog patterns or "static marks" in the emulsion layer. The severity of static-related problems has been exacerbated greatly by increases in sensitivity of new emulsions, coating machine speeds, and post-coating drying efficiency. The generation of electrostatic charge during film coating results primarily from the tendency of webs of to undergo triboelectric charging during winding and unwinding operations, during conveyance through coating machines, and during finishing operations such as slitting and spooling. Static charge also can be generated during use of a photographic film product. In an automatic camera, the process of winding roll film out of and back into the film cassette, especially at low relative humidity, can produce static charging and marking. Similarly, high-speed automated film processing equipment can generate static charging resulting in marking. Sheet films are subject to electrostatic charging, especially during use in automated high-speed film cassette loaders (e.g., x-ray films, graphic arts films).

It is widely known and accepted that accumulated electrostatic charge can be dissipated effectively by incorporating one or more electrically conductive "antistatic" layers into the overall film structure. Antistatic layers can be applied to one or to both sides of the film support as subbing layers either underlying or on the side opposite to the sensitized emulsion layer. Alternatively, an antistatic layer can be applied as the outermost coated layer either over the emulsion layers (i.e., as an overcoat) or on the side of the film support opposite to the emulsion layers (i.e., as a backcoat) or both. For some applications, the antistatic function can be included in the emulsion layers or pelloid layers as an intermediate layer. A wide variety of electrically conductive materials can be incorporated in antistatic layers to produce a broad range of surface conductivities. Many of the traditional antistatic layers used for photographic applications employ materials which exhibit predominantly ionic conductivity. Antistatic layers containing simple inorganic salts, alkali metal salts of surfactants, alkali metal ion-stabilized colloidal retal oxide sols, ionic conductive polymers or polymeric electrolytes containing alkali metal salts and the like have been taught in Prior Art. The electrical conductivities of such ionic conductors are typically strongly dependent on the temperature and relative humidity of the surrounding environment. At low relative humidities and temperatures, the diffusional mobilities of the charge carrying ions are greatly reduced and the bulk conductivity is substantially decreased. At high relative humidities, an exposed antistatic backcoating can absorb water, swell, and soften. Especially in the case of roll films, this can result in a loss of adhesion between layers as well as physical transfer of portions of the backcoating to the emulsion side of the film (viz. blocking). Also, many of the inorganic salts, polymeric electrolytes, and low molecular weight surface-active agents typically used in such antistatic layers are water soluble and can be leached out during film processing, resulting in a loss of antistatic function.

One of the numerous methods proposed by prior art for increasing the electrical conductivity of the surface of photographic light-sensitive materials in order to dissipate accumulated electrostatic charge involves the incorporation of at least one of a wide variety of surfactants or coating aids in the outermost (surface) protective layer overlying the emulsion layer(s). A wide variety of ionic-type surfactants have been evaluated as antistatic agents including anionic, cationic, and betaine-based surfactants of the type described, for example, in U.S. Pat. Nos. 3,082,123; 3,201,251; 3,519,561; and 3,625,695; German Patent Nos. 1,552,408 and 1,597,472; and others. The use of nonionic surfactants having at least one polyoxyethylene group as antistatic agents has been disclosed in U.S. Pat. Nos. 4,649,102 and 4,891,307; British Patent No. 861,134; German Patent Nos. 1,422,809 and 1,422,818; and others. Further, surface protective layers containing nonionic surfactants having at least two polyoxyethylene groups have been disclosed in U.S. Pat. No. 4,510,233. In order to provide improved performance, the incorporation of an anionic surfactant having at least one polyoxyethylene group in combination with a nonionic surfactant having at least one polyoxyethylene group in the surface layer was disclosed in U.S. Pat. No. 4,649,102. A further improvement in antistatic performance by incorporating a fluorine-containing ionic surfactant having a polyoxyethylene group into a surface layer containing either a nonionic surfactant having at least one polyoxyethylene group or a combination of nonionic and anionic surfactants having at least one polyoxyethylene group was disclosed in U.S. Pat. Nos. 4,510,233 and 4,649,102. Additionally, surface or backing layers containing a combination of specific cationic and anionic surfactants having at least one polyoxyethylene group in each which form a water-soluble or dispersible complex with a hydrophilic colloid binder are disclosed in European Patent Appl. No. 650,088 and British Patent Appl. No. 2,299,680 to provide good antistatic properties both before and after processing without dye staining.

Surface layers containing either non-ionic or anionic surfactants having polyoxyethylene groups often demonstrate specificity in their antistatic performance such that good performance can be obtained against specific supports and photographic emulsion layers but poor performance results when they are used with others. Surface layers containing fluorine-containing ionic surfactants of the type described in U.S. Pat. Nos. 3,589,906; 3,666,478; 3,754,924; 3,775,236; and 3,850,642; British Patent Nos. 1,293,189; 1,259,398; 1,330,356 and 1,524,631 generally exhibit negatively-charging triboelectrification when brought into contact with various materials. Such fluorine-containing ionic surfactants exhibit variability in triboelectric charging properties after extended storage, especially after storage at high relative humidity. However, it is possible to reduce triboelectric charging from contact with specific materials by incorporating into a surface layer other surfactants which exhibit positively-charging triboelectrification against these specific materials. The dependence of the triboelectrification properties of a surface layer on the specific materials with which it is brought into contact can be somewhat reduced by adding a large amount of fluorine-containing nonionic surfactants of the type disclosed in U.S. Pat. No. 4,175,969. However, the use of large amounts of the fluorine-containing surfactants can result in decreased emulsion sensitivity, increased tendency for blocking, and increased dye staining during processing. Thus, it is extremely difficult to minimize the level of triboelectric charging against all those materials with which an imaging element may come into contact without seriously degrading other requisite performance characteristics of the imaging element.

The inclusion in a surface or backing layer of a combination of three kinds of surfactants, comprising at least one fluorine-containing nonionic surfactant, and at least one fluorine-containing ionic surfactant, and a fluorine-free nonionic surfactant has been disclosed in U.S. Pat. No. 4,891,307 to reduce triboelectric charging, prevent dye staining during processing, maintain antistatic properties after storage, and maintain sensitometric properties of the photosensitive emulsion layer. The level of triboelectric charging of surface or backing layers containing the indicated combination of surfactants against dissimilar materials (e.g., rubber and nylon) is said to be sufficiently low such that little or no static marking of the sensitized emulsion occurs. The incorporation of another ionic antistatic agent, such as colloidal metal oxide particles of the type described in U.S. Pat. Nos. 3,062,700 and 3,245,833 into the surface layer containing said combination of surfactants was also disclosed in U.S. Pat. No. 4,891,307.

The use of a hardened gelatin-containing conductive surface layer containing a soluble antistatic agent (e.g., Tergitol 15-S-7), an aliphatic sulfonate-type surfactant (e.g., Hostapur SAS-93), a matting agent (e.g., silica, titania, zinc oxide, polymeric beads), and a friction-reducing agent (e.g., Slip-Ayd SL-530) for graphic arts and medical x-ray films is taught in U.S. Pat. No. 5,368,894. Further, a method for producing a multilayered photographic element in which the conductive surface layer is applied in tandem with the underlying sensitized emulsion layer(s) is also claimed in U.S. Pat. No. 5,368,894. A surface protective layer containing a composite matting agent consisting of a polymeric core particle surrounded by a layer of colloidal metal oxide particles and optionally, conductive metal oxide particles and a nonionic, anionic or cationic surfactant has been disclosed in U.S. Pat. No. 5,288,598.

Antistatic layers incorporating electronic rather than ionic conductors also have been described extensively in the prior art. Because the electrical conductivity of such layers depends primarily on electronic mobilities rather than on ionic mobilities, the observed conductivity is independent of relative humidity and only slightly influenced by ambient temperature. Antistatic layers containing conjugated conductive polymers, conductive carbon particles, crystalline semiconductor particles, amorphous semiconductive fibrils, and continuous semiconductive thin films or networks are well known in the prior art. Of the various types of electronic conductors previously described, electroconductive metal-containing particles, such as semiconductive metal oxide particles, are particularly effective. Fine particles of crystalline metal oxides doped with appropriate donor heteroatoms or containing oxygen deficiencies are sufficiently conductive when dispersed with polymeric film-forming binders to be used to prepare optically transparent, humidity insensitive, antistatic layers useful for a wide variety of imaging applications, as disclosed in U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,368,995; 5,382,494; 5,459,021; and others. Suitable claimed conductive metal oxides include: zinc oxide, titania, tin oxide, alumina, indium sesquioxide, zinc antimonate, indium antimonate, silica, magnesia, zirconia, barium oxide, molybdenum trioxide, tungsten trioxide, and vanadium pentoxide. Of these, the semiconductive metal oxide most widely used in conductive layers for imaging elements is a crystalline antimony-doped tin oxide, especially with a preferred antimony dopant level between 0.1 and 10 atom percent Sb (viz., $Sb_xSn_{1-x}O_2$) as disclosed in U.S. Pat. No. 4,394,441.

An electroconductive protective overcoat overlying a sensitized silver halide emulsion layer of a black-and white photographic element comprising at least two layers both containing granular conductive metal oxide particles and gelatin but at different metal oxide particle-to-gelatin weight ratios has been taught in Japanese Kokai A-63-063035. The outermost layer of the protective overcoat contains a substantially lower total dry coverage of conductive metal oxide (e.g., 0.75 g/m$^2$ vs 2.5 g/m$^2$) present at a lower metal oxide particle-to-gel weight ratio (e.g., 2:1 vs 4:1) than that of the innermost conductive layer.

The use of electroconductive antimony-doped tin oxide granular particles in combination with at least one fluorine-containing surfactant in a surface, overcoat or backing layer has been disclosed broadly in U.S. Pat. Nos. 4,495,276; 4,999,276; 5,122,445; 5,238,801; 5,254,448; and 5,378,577 and also in Japanese Kokai Nos. A-07-020,610 and B-91-024,656. The fluorine-containing surfactant is preferably located in the same layer as the conductive tin oxide particles to provide improved antistatic performance. A surface protective layer or backing layer comprising at least one fluorine-containing surfactant, at least one nonionic surfactant having at least one polyoxyethylene group, and optionally one or both of conductive metal oxide granular particles or a conductive polymer or conductive latex is disclosed in U.S. Pat. No. 5,582,959. The addition of electroconductive metal oxide particles to a subbing, backing, intermediate or anti-halation layer was disclosed as a particularly preferred embodiment. Further, addition of a nonionic surfactant having at least one polyoxyethylene group and a fluorine-containing surfactant, either singly or in combination, to a surface protective or backing layer was disclosed in another particularly preferred embodiment. However, the inclusion of conductive metal oxide particles in a surface protective layer was neither taught by examples nor claimed.

Similarly, a silver halide photographic material comprising an outermost layer overlying a sensitized silver halide emulsion layer containing an organopolysiloxane and a nonionic surfactant having at least one polyoxyethylene group, optionally combined with or replaced by one or more fluorine-containing surfactants or polymers, and a backing layer containing electroconductive metal oxide particles is disclosed in U.S. Pat. No. 5,137,802. The backing layer is located on the opposite side of the support from said outermost layer overlying the emulsion layer. The incorporation of an organopolysilane, a nonionic surfactant having a polyoxyethylene group and/or a fluorine-containing surfactant or polymer in said outermost layer was disclosed as providing excellent antistatic performance with a minimum degree of deterioration with storage time, and negligible occurrence of static marking.

A conductive, surface protective layer comprising fibrous titanium dioxide or potassium titanate particles surface-coated with electroconductive metal oxide fine particles (e.g., Sb-doped tin oxide) in combination with at least one fluorine-containing surfactant is disclosed in U.S. Pat. Nos. 5,122,445 and 5,582,959 and in Japanese Kokai No. A-63-098656.

The use of single phase, acicular, electrically-conductive, metal-containing particles in an outermost protective layer overlying sensitized silver halide emulsion layer(s) or pelloid layer(s) or in an abrasion-resistant backing layer optionally in combination with a transparent magnetic layer has been disclosed in co-pending U.S. patent application Ser. Nos. 08/746,618 and 08/747,480 (both filed Nov. 12, 1996) assigned to the same assignee as the present Application. However, the use of at least one or a combination of charge control agents with such acicular, conductive, metal-containing particles in a surface protective layer is neither taught by examples nor disclosed.

As indicated hereinabove, the prior art for electrically-conductive overcoat layers containing ionic surfactants or combinations of ionic and nonionic surfactants and for antistatic layers containing electrically-conductive metal oxide particles useful for imaging elements is extensive and discloses a wide variety of overcoat layer compositions. However, there is still a critical need in the art for a conductive overcoat which not only effectively dissipates accumulated electrostatic charge, but also minimizes triboelectric charging against a wide variety of materials with which an imaging element may be expected to come into contact. In addition to providing superior antistatic performance, such conductive overcoat layer also must be highly transparent, resist the effects of humidity change, strongly adhere to the underlying layer, exhibit suitable mushiness and abrasion and scratch resistance, and not exhibit ferrotyping or blocking, not exhibit adverse sensitometric effects, not impede the rate of development, not exhibit dusting, and still be manufacturable at a reasonable cost. It is toward the objective of providing such improved electrically-conductive, non-charging overcoat layers that more effectively meet the diverse needs of imaging elements, especially of silver halide photographic films, than those of the prior art that the present invention is directed.

SUMMARY OF THE INVENTION

The present invention is a multilayer imaging element which includes a support, one or more image-forming layers superposed on the support, and an outermost transparent electrically-conductive, non-charging, overcoat layer superposed on the support. The overcoat layer includes colloidal, acicular electrically-conductive metal-containing particles, dispersed in a film-forming binder at a volume percentage of acicular conductive metal-containing particles of from 2 to 60. The overcoat layer further includes a first charge control agent which imparts positive charging properties and a second charge control agent which imparts negative charging properties.

Figure 1:
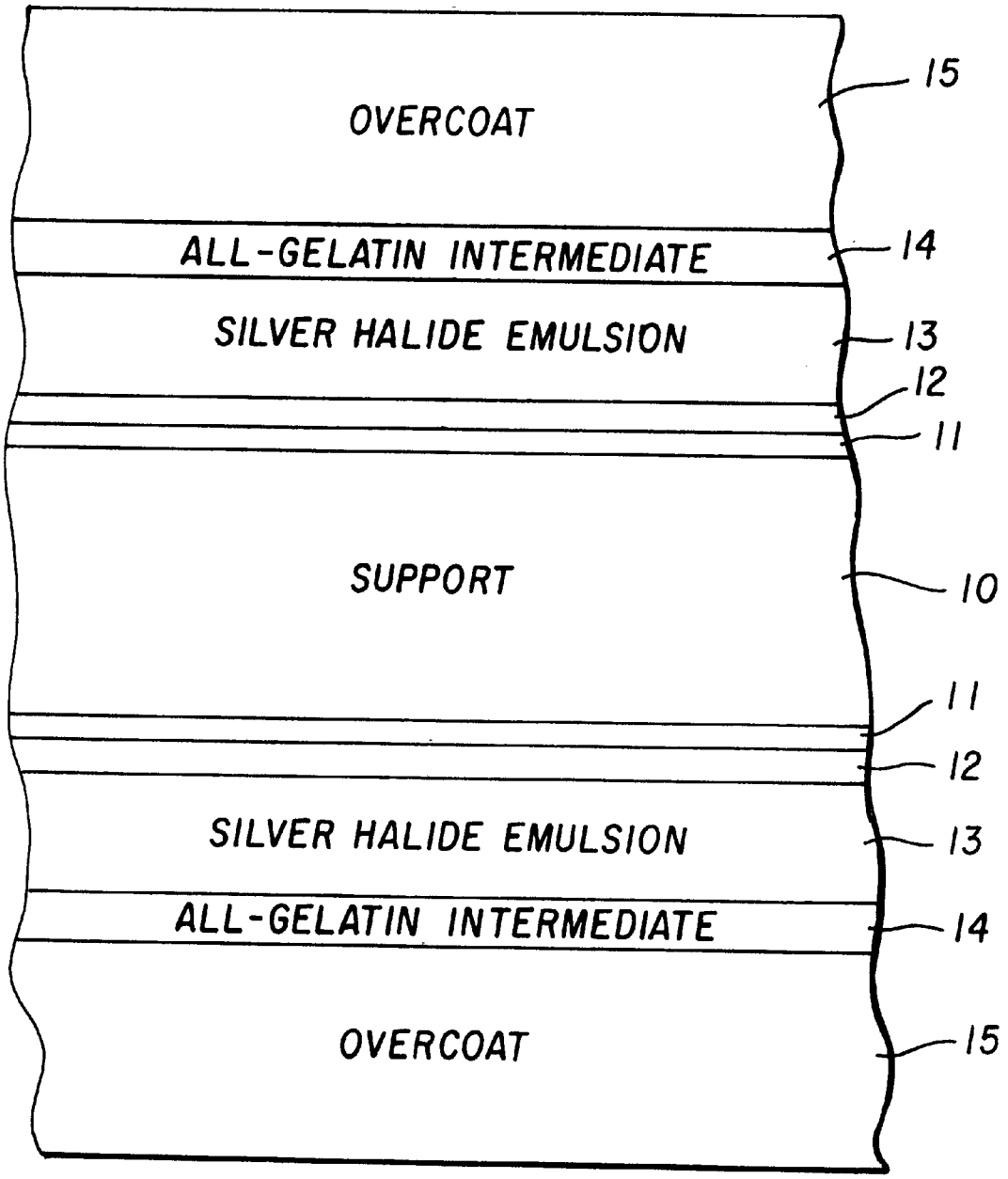
FIG. 1 shows an x-ray film structure using the overcoat of the present invention.

For a better understanding of the present invention together with other advantages and capabilities thereof, reference is made to the following description in connection with the above-described drawings.

DETAILED DESCRIPTION OF THE INVENTION

This invention relates to improved imaging elements containing a support, at least one image-forming layer, and at least one electrically-conductive protective layer, wherein the electrically-conductive protective layer contains colloidal, electronically-conductive, metal-containing acicular particles dispersed in a polymeric, film-forming binder, and a first charge control agent which imparts positive charging properties and a second charge control agent which imparts negative charging properties. The electrically-conductive protective layer either directly overlies an image-forming layer or an optional intermediate layer overlying an image-forming layer as an outermost, surface or overcoat layer. The resulting imaging element exhibits improved electrostatic charge control performance without adversely impacting inter-layer adhesion or mushiness when compared to imaging elements of the prior art.

The transparent, electrically-conductive, non-charging overcoat layer of the present invention serves to protect the silver halide sensitized emulsion layer(s) from the effects of accumulated electrostatic charge, such as dirt attraction, physical defects during manufacturing, uneven motion during conveyance, and irregular 'fog' patterns resulting from triboelectric charging as well as from static marking produced by the discharge of accumulated electrostatic charge. The electrically-conductive, non-charging overcoat layer comprises crystalline, acicular, electrically-conductive, metal-containing particles to provide superior dissipation of accumulated electrostatic charge and a combination of charge control agents to minimize the level of triboelectric charging. Electrically-conductive acicular metal-containing particles in accordance with this invention exhibit a cross-sectional diameter $\leqq 0.02\ \mu m$ and an aspect ratio of at least 2:1 (length to cross-sectional diameter)and preferably $\geqq 5:1$. As a result of the higher aspect ratio of the conductive acicular metal-containing particles of this invention, increased conductivity can be obtained at a lower volume percent loading of acicular metal-containing particles than with granular metal-containing particles. The combination of charge control agents includes a suitable negatively-charging charge control agent and a suitable positively-charging charge control agent at low concentrations optimized to minimize triboelectric charging.

The principal advantage of the conductive overcoat layer of this invention derives from the use of a specific class of acicular, conductive, metal-containing particles in combination with a first charge control agent imparting positive charging properties and a second charge control agent imparting negative charging properties. The acicular, electrically-conductive, metal-containing particles of the present invention exhibit enhanced efficiency of conductive network formation relative to nominally spherical, granular metal-containing particles with comparable cross-sectional diameters of prior art. Therefore, a substantially lower volume fraction of such acicular, conductive metal-containing particles relative to film-forming binder can be used to produce a specified level of conductivity. This can result in decreased optical losses from haze and surface scattering and also can lead to decreased cutting tool wear and dirt generation in film-finishing operations. Further, an increase in the volume fraction of the binder in the conductive layer results in improvements in adhesion to underlying emulsion layer(s) and to optional matte particles.

Acicular, electronically-conductive metal-containing particles used in accordance with this invention are single phase, crystalline, and have nanometer-size dimensions. Suitable dimensions for the acicular particles are less than 0.05 μm in cross-sectional diameter (minor axis) and less than 1 μm in length (major axis), preferably less than 0.02 μm in cross-sectional diameter and less than 0.5 μm in length, and more preferably less than 0.01 μm in cross-sectional diameter and less than 0.15 μm in length. These dimensions tend to minimize optical losses of coated layers containing such particles due to Mie-type scattering by the particles. A mean aspect ratio (major/minor axes) of at least 2:1 is suitable; a mean aspect ratio of greater than or equal to 5:1 is preferred; and a mean aspect ratio of greater than or equal to 10:1 is more preferred for acicular conductive metal-containing particles in accordance with this invention. An increase in mean aspect ratio of acicular conductive particles is known to result in an improvement in the volumetric efficiency of conductive network formation.

One particularly useful class of acicular, electrically-conductive, metal-containing particles includes acicular, semiconductive metal oxide particles. Acicular, semiconductive metal oxide particles suitable for use in the conductive overcoat layers of this invention exhibit a specific (volume) resistivity of less than $1\times10^4$ ohm·cm, more preferably less than $1\times10^2$ ohm·cm, and most preferably, less than $1\times10^1$ ohm·cm. One example of a preferred acicular semiconductive metal oxide is the acicular electroconductive tin oxide described in U.S. Pat. No. 5,575,957 which is available under the tradename "FS-10P" from Ishihara Techno Corporation. The electroconductive tin oxide includes acicular particles of single phase, crystalline tin oxide doped with about 0.3–5 atom percent antimony. The specific (volume) resistivity of the acicular tin oxide is about 10–100 ohm·cm when measured as a packed powder using a DC two-probe test cell similar to that described in U.S. Pat. No. 5,236,737. The mean dimensions of such acicular tin oxide particles determined by image analysis of transmission electron micrographs are approximately 0.01 μm in cross-sectional diameter and 0.1 μm in length with a mean aspect ratio of about 10:1. An x-ray powder diffraction analysis of the acicular tin oxide has confirmed that it is single phase and highly crystalline. The typical mean value for x-ray crystallite size determined in the manner described in U.S. Pat. No. 5,484,694 is about 200 Å for the as-supplied dry powder. Other suitable acicular electroconductive metal oxides include, for example, a tin-doped indium sesquioxide similar to that described in U.S. Pat. No. 5,580,496, but with a smaller mean cross-sectional diameter, aluminum-doped zinc oxide, niobium-doped titanium dioxide, an oxygen-deficient titanium suboxide, $TiO_x$, where $x<2$ and a titanium oxynitride, $TiO_xN_y$, where $(x+y)\leqq2$, similar to those phases described in U.S. Pat. No. 5,320,782, a composite acicular electroconductive metal oxide containing an electroconductive outer shell deposited on a nonconductive acicular core particle, such as those described in U.S. Pat. Nos. 5,122,445 and 5,582,959 and in Japanese Kokai No. 63-098656 but with a smaller mean cross-sectional diameter and length. Additional examples of other non-oxide, acicular, electrically-conductive, metal-containing particles include selected metal carbides, nitrides, suicides, and borides.

The small average dimensions of acicular conductive metal-containing particles in accordance with this invention minimize the amount of light scattering and result in increased optical transparency and decreased haze for conductive overcoat layers of this invention. In addition to maintaining transparency, the small average dimensions of the acicular particles also promote the formation of a multitude of interconnected chains of particles into an extended network which in turn provides a multiplicity of electrically-conductive pathways, even in thin coated layers. The high aspect ratio of such acicular particles results in greater efficiency of conductive network formation compared to nominally spherical conductive particles of comparable cross-sectional diameter as taught, for example, in Japanese Kokai No. A-63-063035. This increased efficiency of conductive network formation permits the use of lower volume fractions of acicular conductive particles relative to polymeric binder to achieve effective levels of surface electrical conductivity. It is an especially important feature of this invention that it produces relatively high levels of electrical conductivity using relatively low volume fractions of acicular conductive metal-containing particles. Further, increasing the volume fraction of polymeric binder improves various binder-related properties of the overcoat layer such as adhesion to an underlying layer, cohesion of the overcoat layer, and retention of optional matte particles which can result in lower dusting. Also, at the lower particle to binder ratios possible with acicular conductive metal-containing particles in accordance with this invention, transparency is increased and surface scattering (i.e., haze) is decreased.

The acicular conductive metal-containing particles can constitute about 2 to 60 volume percent of the conductive overcoat layer of this invention. The amount of acicular conductive metal-containing particles contained in the conductive overcoat layer is defined in terms of volume percent rather than weight percent since the densities of the various suitable conductive particles vary widely. For the acicular antimony-doped tin oxide particles described hereinabove, this corresponds to tin oxide particle to polymeric binder weight ratios of from approximately 1:4 to 9:1. The optimum ratio of conductive particles to binder varies depending on particle size, binder type, and conductivity requirements of the particular imaging element. Use of significantly less than about 2 volume percent of acicular conductive metal-containing particles will not provide a useful level of surface electrical conductivity. Use of more than 60 volume percent of acicular conductive metal-containing particles defeats several of the objectives of this invention in that it results in increased dusting, reduced transparency and increased haze due to scattering losses, diminished adhesion between the overcoat layer and underlying emulsion layer(s). Thus, the conductive overcoat layer of this invention comprises acicular, conductive, metal-containing particles in the amount of 60 volume percent or less, preferably 30 volume percent or less, and more preferably, 20 volume percent or less.

The choice of the particular combination of charge control agents to be used with the conductive metal-containing acicular particles in the overcoat layer is extremely important to the method of this invention. The combination of charge control agents and metal-containing particles must be optimized so as to provide a minimum (preferably zero) level of triboelectric charging and a maximum efficiency of electrostatic charge dissipation. Typically, a suitable concentration of a positively-charging charge control agent is used in combination with a suitable concentration of a negatively-charging charge control agent. Combinations of charge control agents/coating aids useful in conducting overcoats of this invention comprise at least one of each of the following two groups of compounds, (i) and (ii):

(i) a positive charging anionic compound represented by the following formulas (1) and (2), $$R—(A)—SO_3M \quad (1)$$

where R represents an alkyl or alkenyl group (preferably an alkyl group having 10 to 18 carbon atoms or alkenyl group having 14 to 18 carbon atoms) or alkyl aryl group (preferably an alkyl aryl group having 12–18 carbon atoms, such as $C_8H_{17}—(C_6H_4)—$ or $C_9H_{19}—(C_6H_4)—$); A represents a single covalent bond or —O— or $—(OCH_2CH_2)_m—O_n—$; wherein m is an integer from 1 to 4 and n is zero or 1; and M represents an alkali metal cation such as sodium, potassium or an ammonium group, or an alkyl-substituted ammonium group.

Formula (2) is a sulfosuccinate compound $$R_2—O—\overset{O}{\overset{\|}{C}}—CH_2—\underset{\underset{SO_3M}{|}}{CH}—\overset{O}{\overset{\|}{C}}—O—R_3 \quad (2)$$

where $R_2$ and $R_3$ represent the same or different alkyl or alkyl-aryl groups and wherein the preferred alkyl groups contain 6 to 10 carbon atoms, and alkyl-aryl groups contain 7 to 10 carbon atoms; where M is a cation as defined above for formula (1).

ii) a negative charging fluorine-containing anionic or nonionic compound having a fluoroalkyl or fluoroalkenyl group and a hydrophilic group, which is represented by the formulae (3), (4), (5) or (6)

$$R_f—(\overset{R_4}{\overset{|}{SO_2N}})_n—(CH_2)_a—B \quad (3)$$

where $R_f$ represents a perfluorinated alkyl or alkenyl group having 6 to 12 carbon atoms; $R_4$ represents a methyl or ethyl group or a hydrogen atom; n has a value of 0 or 1; a has a value of 0, 1, 2 or 3, when n is zero or a value of 1, 2 or 3, when n is one: and B represents an anionic hydrophilic group such as $—SO_3M$, $—OSO_3M$ or $—CO_2M$, where M is a cation as defined above for formula (1), or a nonionic hydrophilic group such as $—O(CH_2CH_2O)_y—D$, where y is 4 to 16 and D is —H or $—CH_3$.

Formula 4 is:

$$R'_f—O—\overset{O}{\overset{\|}{C}}—CH_2—\underset{\underset{SO_3M}{|}}{CH}—\overset{O}{\overset{\|}{C}}—O—R''_f \quad (4)$$

where $R'_f$ and $R''_f$ represent the same or different fluorinated alkyl group having 4 to 10 carbon atoms and at least 7 fluorine atoms, including 3 fluorine atoms on the end carbon atom; M is a cation defined above for formula (1).

Formula 5 includes the following compounds:

$$R'''_f—(CH_2)_2—S—\underset{\underset{CH_2—X}{|}}{CH}—CO_2H \quad \text{or} \quad (5)$$

$$R'''_f—(CH_2)_2—S—\underset{\underset{CH_2CO_2H}{|}}{CH}—X$$

where $R'''_f$ represents a mixture of perfluorinated alkyl groups having 6, 8 and 10 carbon atoms, and X is $—CONH(CH_2)_3N(CH_3)_2$.

Formula 6 is the following compound:

$$R_f—Y—D \quad (6)$$

where $R_f$ is defined in Formula (3), and Y is a suitable nonionic hydrophilic group such as $—(CH_2CH_2O)_b—$ where b is 6 to 20, or $—(CH_2CH(OH)CH_2O)_d—$ where d is 6 to 16 and where D is —H or $—CH_3$.

Polymeric film-forming binders useful in conductive overcoat layers prepared by the method of this invention include: water-soluble, hydrophilic polymers such as gelatin, gelatin derivatives, maleic acid anhydride copolymers; cellulose derivatives such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of polyurethanes or polyesterionomers. Gelatin and gelatin derivatives are the preferred binders.

Solvents useful for preparing dispersions of conductive acicular metal-containing particles by the method of this invention include: water; alcohols such as methanol, ethanol, propanol, isopropanol; ketones such as acetone, methylethyl ketone, and methylisobutyl ketone; esters such as methyl acetate, and ethyl acetate; glycol ethers such as methyl cellusolve, ethyl cellusolve; and mixtures thereof. Preferred solvents include water, alcohols, and acetone.

In addition to binders and solvents, other components that are well known in the photographic art also can be included in the conductive overcoat layer of this invention. Other addenda, such as matting agents, surfactants or coating aids, polymer lattices, thickeners or viscosity modifiers, hardeners or cross linking agents, soluble antistatic agents, antifoggants, lubricating agents, and various other conventional additives optionally can be present in any or all of the layers of the multilayer imaging element.

Colloidal dispersions of conductive, metal-containing, acicular particles formulated with the preferred combination of charge control agents, polymeric film-forming binder, and additives can be applied to imaging elements coated onto a variety of supports. Typical photographic film supports include: cellulose nitrate, cellulose acetate, cellulose acetate butyrate, cellulose acetate propionate, poly(vinyl acetal), poly(carbonate), poly(styrene), poly(ethylene terephthalate), poly(ethylene naphthalate), poly(ethylene terephthalate) or poly(ethylene naphthalate) having included therein a portion of isophthalic acid, 1,4-cyclohexane dicarboxylic acid or 4,4-biphenyl dicarboxylic acid used in the preparation of the film support; polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers, polycarbonates, and the like; blends or laminates of the above polymers. Supports can be either transparent or opaque depending upon the application. Transparent film supports can be either colorless or colored by the addition of a dye or pigment. Film supports can be surface-treated by various processes including corona discharge, glow discharge, UV exposure, flame treatment, electron-beam treatment, as described in U.S. patent application Ser. No. 08/662,188 (filed Jun. 12, 1996) assigned to the same assignee as the present application, or treatment with adhesion-promoting agents including dichloro- and trichloro-acetic acid, phenol derivatives such as resorcinol and p-chloro-m-cresol, solvent washing or overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, mixtures and blends thereof, and the like. Other suitable opaque or reflective supports are paper, polymer-coated paper, including polyethylene-, polypropylene-, and ethylene-butylene copolymer-coated or laminated paper, synthetic papers, pigment-containing polyesters, and the like. Of these supports, films of cellulose triacetate, poly (ethylene terephthalate), and poly(ethylene naphthalate) prepared from 2,6-naphthalene dicarboxylic acids or derivatives thereof are preferred. The thickness of the support is not particularly critical. Support thicknesses of 2 to 10 mils (50 $\mu$m to 254 $\mu$m) are suitable for photographic elements in accordance with this invention.

Aqueous dispersions of acicular conductive metal-containing particles can be prepared in the presence of appropriate levels of optional dispersing aids, colloidal stabilizing agents or polymeric co-binders by any of various mechanical stirring, mixing, homogenization or blending processes well-known in the art of pigment dispersion and paint making. Alternatively, stable colloidal dispersions of suitable conductive metal-containing acicular particles can be obtained commercially, for example, a stabilized dispersion of electroconductive antimony-doped tin oxide acicular particles at nominally 20 weight percent solids is available under the tradename "FS-10D" from Ishihara Techno Corporation. Formulated dispersions containing colloidal acicular, conductive metal-containing particles and the preferred combination of charge control agents, polymeric binder, and additives can be applied to the aforementioned film or paper supports by any of a variety of well-known coating methods. Handcoating techniques include using a coating rod or knife or a doctor blade. Machine coating methods include air doctor coating, reverse roll coating, gravure coating, curtain coating, bead coating, slide hopper coating, extrusion coating, spin coating and the like, and other coating methods well known in the art.

The electrically-conductive overcoat layer of this invention can be applied to the support at any suitable coverage depending on the specific requirements of a particular type of imaging element. For example, for silver halide photographic films, dry coating weights of the preferred acicular antimony-doped tin oxide in the conductive overcoat layer are preferably in the range of from about 0.01 to 2 g/m$^2$. More preferred dry coverages are in the range of about 0.02 to 0.5 g/m$^2$. The conductive overcoat layer of this invention typically exhibits a surface resistivity (20% RH, 20° C.) of less than $1\times10^{10}$ ohms/square, preferably less than $1\times10^{9}$ ohms/square, and more preferably less than $1\times10^{8}$ ohms/square.

The imaging elements of this invention can be of many different types depending on the particular use for which they are intended. Such imaging elements include, for example, photographic, thermographic, electrothermographic, photothermographic, dielectric recording, dye migration, laser dye-ablation, thermal dye transfer, electrostatographic, electrophotographic imaging elements, and others. Details with respect to the composition and function of this wide variety of imaging elements are provided in co-pending U.S. patent application Ser. Nos. 08/746,618 and 08/747,480 (both filed Nov. 12, 1996) assigned to the same assignee as the present Application and incorporated herein by reference. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially examples 16 and 21, are particularly suitable. Any of the known silver halide emulsion layers, such as those described in *Research Disclosure,* Vol. 176, Item 17643 (December, 1978) and *Research Disclosure,* Vol. 225, Item 22534 (January, 1983), and *Research Disclosure,* Item 36544 (September, 1994), and *Research Disclosure,* Item 37038 (February, 1995) and the references cited therein are useful in preparing photographic elements in accordance with this invention.

In a particularly preferred embodiment, imaging elements comprising electrically-conductive overcoat layers of this invention are photographic elements which can differ widely in structure and composition. For example, said photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive overcoat layer of the present invention in small format films as described in *Research Disclosure,* Item 36230 (June 1994). Photographic elements can be either simple black-and-white or monchrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

Conductive overcoat layers of this invention can be incorporated into multilayer photographic elements in any of various configurations depending upon the requirements of the specific application. A conductive overcoat layer can be applied directly over the sensitized emulsion layer(s), on the side of the support opposite the emulsion layer(s), as well as on both sides of the support. When a conductive overcoat layer containing conductive, metal-containing granular particles is applied over a sensitized emulsion layer, it is not necessary to apply any intermediate layers such as barrier layers or adhesion-promoting layers between the overcoat layer and the sensitized emulsion layer(s), although they can optionally be present. Alternatively, a conductive overcoat layer can be applied as part of a multi-component curl control layer (i.e., pelloid) on the side of the support opposite to the sensitized emulsion layer(s). In the case of photographic elements for direct or indirect x-ray applications, the conductive overcoat layer can be applied on either side or both sides of the film support. In one type of photographic element, the conductive overcoat layer is present on only one side of the support and the sensitized emulsion coated on both sides of the film support. Another type of photographic element contains a sensitized emulsion on only one side of the support and a pelloid layer containing gelatin on the opposite side of the support. Conductive overcoat layers of this invention can be applied so as to overlie the sensitized emulsion layer(s) or alternatively, the pelloid layer or both.

The conductive overcoat layer of this invention also can be incorporated in an imaging element comprising a support, an imaging layer, and a transparent magnetic recording layer containing magnetic particles dispersed in a polymeric binder. Such imaging elements are well-known and are described, for example, in U.S. Pat. Nos. 3,782,947; 4,279,945; 4,302,523; 4,990,276; 5,147,768; 5,215,874; 5,217,804; 5,227,283; 5,229,259; 5,252,441; 5,254,449; 5,294,525; 5,335,589; 5,336,589; 5,382,494; 5,395,743; 5,397,826; 5,413,900; 5,427,900; 5,432,050; 5,457,012; 5,459,021; 5,491,051; 5,498,512; 5,514,528; and others; and in *Research Disclosure,* Item No. 34390 (November, 1992) and references cited therein. Such elements are particularly advantageous because they can be employed to record images by the customary imaging processes while at the same time additional information can be recorded into and read from a transparent magnetic layer by techniques similar to those employed in the magnetic recording art. Said transparent magnetic recording layer comprises a film-forming polymeric binder, magnetic particles, and other optional addenda for improved manufacturabilty or performance such as dispersants, coating aids, fluorinated surfactants, crosslinking agents or hardeners, catalysts, charge control agents, lubricants, abrasive particles, filler particles, plasticizers and the like. Said magnetic particles can consist of ferromagnetic oxides, complex oxides including other metals, metal alloy particles with protective oxide coatings, ferrites, hexagonal ferrites, etc. and can exhibit a wide variety of shapes, sizes, and aspect ratios. Said magnetic particles also can contain a variety of metal dopants and optionally can be overcoated with a shell of particulate inorganic or polymeric materials to decrease light scattering as described in U.S. Pat. Nos. 5,217,804 and 5,252,444. The preferred ferromagnetic particles for use in transparent magnetic recording layers used in combination with the electrically-conductive overcoat layers of this invention are cobalt surface-treated $\gamma$-$Fe_2O_3$ or magnetite with a specific surface area (BET) greater than 30 $m^2/g$. The transparent, conductive overcoat layer of this invention can be applied so as to overlie emulsion layer(s) on the opposite side of the support from the transparent magnetic recording layer.

Imaging elements incorporating conductive overcoat layers of this invention useful for other specific imaging applications such as color negative films, color reversal films, black-and-white films, color and black-and-white papers, electrographic media, dielectric recording media, thermally processable imaging elements, thermal dye transfer recording media, laser ablation media, and other imaging applications should be readily apparent to those skilled in photographic and other imaging arts.

The method of the present invention is illustrated by the following detailed examples of its practice. However, the scope of this Invention is by no means restricted to these illustrative examples.

EXAMPLE 1

A coating mixture comprising 0.47% lime treated ossein gelatin in water and various additives including a combination of a positively-charging sodium-bis(2-ethylhexyl) sulfosuccinate (Cytec Ind.) charge control agent/coating aid (A) and a negatively-charging perfluorooctyl sulfonate, tetraethylammonium salt (Bayer AG), charge control agent/coating aid (B). Other additives included 0.011% chrome alum hardener, 0.42% bis-vinylsulfonylmethyl ether (BVSME), and 0.0023% polymethylmethacrylate matte particles (1–2 $\mu$m diameter). The concentration of charge control agent/coating aid A was 0.42 g/kg mixture and the concentration of charge control agent/coating aid B was 0.042 g/kg mixture.

This coating mixture was applied using a coating hopper to both sides of a moving web of 178 $\mu$m (7 mil) thick polyethylene terephthalate film support 10 that had been previously coated with: a vinylidene chloride/acrylonitrile/itaconic acid terpolymer undercoat layer 11; a gelatin subbing layer 12; a sensitized TMAT G/RA silver halide emulsion (Eastman Kodak Company) layer 13; and an all-gelatin intermediate layer 14, producing the x-ray film structure shown in FIG. 1. The wet laydown of the overcoat coating solution applied to the previously coated layers was 21.5 $ml/m^2$. The overcoat layer is shown by 15 in FIG. 1.

The surface electrical resistivity (SER) of the conductive overcoat was measured after conditioning for 24 hours at 20% RH, 20° C. using a two-probe parallel electrode method as described in U.S. Pat. No. 2,801,191 incorporated herein by reference.

The net surface charge density (Q) present on a film after contact with and separation from insulating polyurethane or conductive EPDM (ethylene propylene diene monomer) rubber was measured at 20% RH, 20° C. The values obtained for SER, $Q_{poly}$ and $Q_{epdm}$ are reported in Table 1. Antistatic performance for a given overcoat layer formulation is represented by its charging location in the $Q_{poly}$–$Q_{epdm}$ charging space (FIG. 2), with the "0,0" location being most desirable, as can be demonstrated by testing in exposure and processing equipment.

EXAMPLES 2–9

Figure 2:
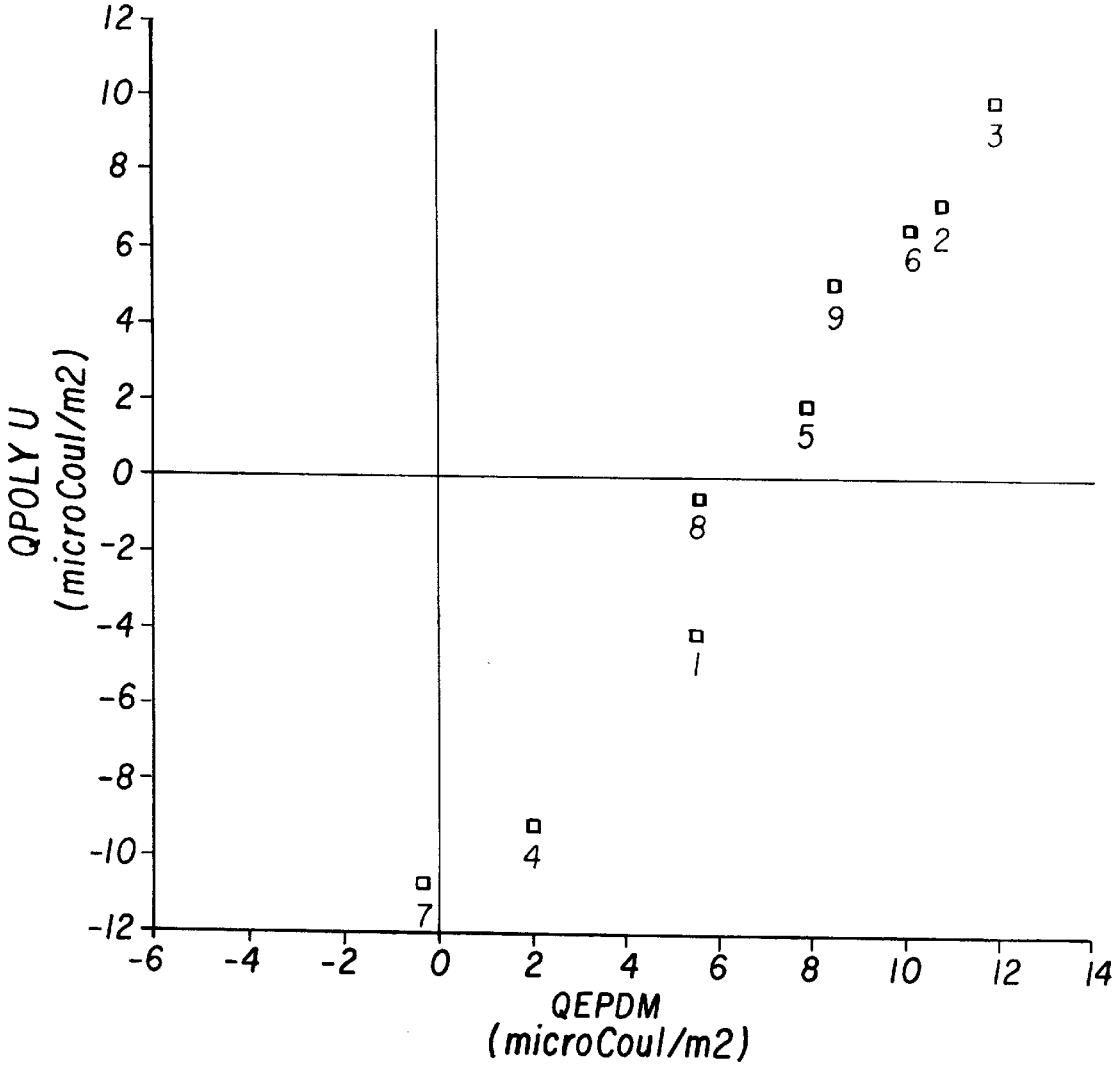
FIG. 2 shows the net charge density using conductive rubber versus the net charge density using an insulating polyurethane for various overcoat layers.

Coating mixtures were prepared and characterized as described in Example 1 except that concentrations of charge control agents/coating aids A and B were varied as listed in Table 1. The range of values for net charge density representing sensitivity to concentration(s) of charge control agent(s) is shown in FIG. 2. The number labels for the points in FIG. 2 correspond to the Example s indicated in Table 1.

TABLE 1

| Example # | Charge Control Agent-A g/kg coating mixture | Charge Control Agent-B g/kg coating mixture | SER 20% RH, 21° C. log (ohm/square) | Charging EPDM microCoul/$m^2$ | Charging PU microCoul/$m^2$ |
|---|---|---|---|---|---|
| 1 | 0.42 | 0.042 | >14 | 5.55 | −4.09 |
| 2 | 0.42 | 0.010 | >14 | 10.85 | 7.19 |
| 3 | 0.42 | 0 | >14 | 11.97 | 9.92 |
| 4 | 0.21 | 0.042 | >14 | 2.04 | −9.13 |
| 5 | 0.21 | 0.010 | >14 | 7.95 | 1.92 |
| 6 | 0.21 | 0 | >14 | 10.15 | 6.55 |
| 7 | 0.10 | 0.042 | >14 | 8.56 | −10.69 |
| 8 | 0.10 | 0.010 | >14 | 5.62 | −0.52 |
| 9 | 0.10 | 0 | >14 | 8.56 | 5.12 |

EXAMPLE 11

A coating mixture containing colloidal, electroconductive FS-10D acicular Sb-doped tin oxide particles (Ishihara Techno Corp.) with 0.47% lime treated ossein gelatin (85/15 $SnO_2$ to gelatin weight ratio) and various additives was prepared. Other additives included 0.011% chrome alum hardener, 0.42% BVMSE hardener, and 0.023% poly (methylmethacrylate) matte particles (1–2 $\mu$m diameter). The concentration of charge control agent/coating aid A was 0.10 g/kg mixture and the concentration of charge control agent/coating aid B was 0.010 g/kg mixture.

This coating mixture was applied using a coating hopper to both sides of a moving web of 178 $\mu$m (7 mil) thick polyethylene terephthalate film support 10 that had been previously coated with: a vinylidene chloride/acrylonitrile/itaconic acid terpolymer undercoat layer 11; a gelatin subbing layer 12; a sensitized TMAT G/RA silver halide emulsion (Eastman Kodak Company) layer 13; and an all-gelatin intermediate layer 14, producing the x-ray film structure shown in FIG. 1 . This corresponds to an acicular Sb-doped tin oxide dry weight coverage of 0.38 g/$m^2$. The resulting overcoat layer was characterized as described in Example 1 and the results reported in Table 2.

EXAMPLES 12–16

Conductive overcoat layers were prepared and characterized as described in Example 11 except that the concentrations of FS-10D acicular Sb-doped tin oxide and gelatin in the coating mixtures were varied in order to obtain the range of acicular tin oxide dry coverage values (at constant $SnO_2$ to gelatin weight ratio=85/15) reported in Table 2. The concentration of charge control agent/coating aid A was 0.10 g/kg mixture and the concentration of charge control agent/coating aid B was 0.010 g/kg mixture. These concentrations were selected as having the lowest charging values as shown in FIG. 2. The values measured for SER, $Q_{poly}$ and $Q_{epdm}$ also are reported in Table 2. Triboelectric charging performance is represented by the relative location of the values for the net surface charge densities, $Q_{poly}$ and $Q_{epdm}$ in the $Q_{poly}$, $Q_{epdm}$ charging space in FIG. 3 with the 0,0 location being most desirable. Note that the number labels for the points in FIG. 3 correspond to the Example numbers for the conductive overcoat layer samples described in Table 2.

COMPARATIVE EXAMPLES 17 AND 28

An acicular tin oxide-free coating mixture was prepared comprising 0.47% lime treated ossein gelatin in water and various additives including a combination of a positively-charging sodium-bis(2-ethylhexyl) sulfosuccinate (Cytec Ind.) charge control agent/coating aid (A) and a negatively-charging perfluorooctyl sulfonate, tetraethylammonium salt (Bayer AG), charge control agent/coating aid (B). Other additives included 0.011% chrome alum hardener, 0.42% bis-vinylsulfonylmethyl ether (BVSME), and 0.0023% polymethylmethacrylate matte particles (1–2 $\mu$m diameter). The concentration of charge control agent/coating aid A was 0.10 g/kg mixture and the concentration of charge control agent/coating aid B was 0.010 g/kg mixture. Overcoat layers were prepared as described in Example 1 and characterized with the results presented in Table 2 and FIG. 3.

As a further comparative sample, samples of 7 mil thick poly(ethylene terephthalate) film support that had been previously coated with: (1) a vinylidene chloride/acrylonitrile/itaconic acid terpolymer primer layer; (2) a gelatin subbing layer; (3) a sensitized TMAT G/RA silver halide emulsion; and (4) an all-gelatin intermediate layer as in Example 1 but without any overcoat layer were characterized in the same manner as the Examples and Comparative Examples. Results are presented in Table 2 for three separate determinations used as controls for the net surface charge density measurements of the test samples.

COMPARATIVE EXAMPLES 18–21

A coating mixture comprising colloidal, electroconductive SN-100D Sb-doped tin oxide granular particles (Ishihara Sangyo Kaisha Ltd.) with lime treated gelatin (85/15 $SnO_2$ to gelatin weight ratio) and various additives was prepared as described in Example 11, substituting the SN-100D granular tin oxide for the FS-10D acicular tin oxide. The concentration of charge control agent/coating aid A was 0.10 g/lkg mixture and the concentration of charge control agent/coating aid B was 0.010 g/kg mixture. Conductive overcoat layers were prepared and characterized as described in Example 11 except that the concentrations of SN-100D granular tin oxide and gelatin in the coating solutions were varied in order to obtain the range of tin oxide dry weight coverage values (at constant $SnO_2$ to gelatin weight ratio=85/15) reported in Table 2. The values measured for SER, $Q_{poly}$ and $Q_{epdm}$ are reported in Table 2.

EXAMPLES 22–24

A coating mixture comprising colloidal, electroconductive FS-10D acicular Sb-doped tin oxide particles (Ishihara Techno Corp.) with lime treated ossein gelatin (70/30 $SnO_2$ to gelatin weight ratio) and various additives was prepared. Additives included 0.011% chrome alum hardener, 0.42% BVSME hardener, and 0.023% poly(methylmethacrylate) matte particles (1–2 $\mu$m diameter). The concentration of charge control agent/coating aid A was 0.10 g/kg mixture and the concentration of charge control agent/coating aid B was 0.010 g/kg mixture. Conductive overcoat layers were prepared and characterized as described in Example 11 except that the concentrations of FS-10D acicular tin oxide and gelatin in the coating solutions were varied in order to obtain the range of acicular tin oxide dry coverage values (at constant $SnO_2$ to gelatin weight ratio=70/30) listed in Table 2. The values measured for SER, $Q_{poly}$, and $Q_{epdm}$ also are reported in Table 2. Triboelectric charging performance for an overcoat layer is represented by the relative location of the values for the net surface charge densities $Q_{poly}$ and $Q_{epdm}$ in the $Q_{poly}$, $Q_{epdm}$ charging space in FIG. 3. The range of net charge density values in FIG. 3 demonstrates the sensitivity of triboelectric charging to the acicular tin oxide to gel weight ratio and the tin oxide dry weight coverage (i.e., surface conductivity).

COMPARATIVE EXAMPLES 25–27

A coating mixture comprising colloidal conductive SN-100D granular Sb-doped tin oxide particles with lime treated gelatin at a $SnO_2$ to gelatin weight ratio of 70/30 and various additives was prepared as described for Examples 22–24 but substituting SN-100D granular tin oxide for FS-10D acicular tin oxide. The concentration of charge control agent/coating aid A was 0.10 g/kg mixture and the concentration of charge control agent/coating aid B was 0.010 g/kg mixture. Conductive overcoat layers were prepared and characterized as described in Example 11 except that the concentrations of SN-100D granular tin oxide and gelatin in the coating solutions were varied in order to obtain the range of tin oxide dry weight coverage values (at constant $SnO_2$ to gelatin weight ratio=70/30) reported in Table 2. The values measured for SER, $Q_{poly}$ and $Q_{epdm}$ also are reported in Table 2.

The effect of an acicular tin-oxide containing overcoat similar to Examples 11–16 and 22–24 on an x-ray film sensitometric response was evaluated by routine testing procedures, and no adverse sensitometric response was observed. Thus, the present invention provides overcoat layers that have no effect on the sensitometry of an x-ray film.

TABLE 2

| Ex. No. | $SnO_2$ Dispers % Solids | Amt $SnO_2$ Dispers (g/kg mixture) | Amt Gelatin (g/kg mixture) | $SnO_2$ Dry wt. Coverage (g/m$^2$) | SER @ 20% RH, 21 ° C. log (Ω/sq) | Charging EPDM (μcoul/m$^2$) | Charging Polyurethane (μcoul/m$^2$) |
|---|---|---|---|---|---|---|---|
| 11 | 20.1 | 87.5 | 3.1 | 0.38 | 8.06 | 0.22 | 1.47 |
| 12 | 20.1 | 75.0 | 2.6 | 0.32 | 8.35 | 0.20 | 1.60 |
| 13 | 20.1 | 62.5 | 2.2 | 0.27 | 8.71 | 0.41 | 1.52 |
| 14 | 20.1 | 50 | 1.8 | 0.21 | 9.25 | 0.21 | 1.37 |
| 15 | 20.1 | 37.5 | 1.3 | 0.16 | 9.97 | 0.82 | 1.56 |
| 16 | 20.1 | 25.0 | 0.9 | 0.11 | 11.44 | 6.82 | 3.52 |
| 17 | — | 0 | 4.7 | 0 | 14 | 13.22 | 8.90 |
| cntrl | — | 0 | 0 | 0 | 14 | 9.43 | 7.82 |
| 18 | 30 | 55.5 | 2.9 | 0.36 | 8.1 | 0.14 | 1.58 |
| 19 | 30 | 44.5 | 2.3 | 0.29 | 8.8 | 0.22 | 1.79 |
| 20 | 30 | 33.3 | 1.8 | 0.21 | 10.1 | 0.84 | 1.78 |
| 21 | 30 | 22.2 | 1.2 | 0.14 | 13.8 | 7.04 | 4.38 |
| cntrl | — | 0 | 0 | 0 | 14 | 8.6 | 7.62 |
| 22 | 20.1 | 87.5 | 7.5 | 0.38 | 9.9 | 0.98 | 2.44 |
| 23 | 20.1 | 62.5 | 5.4 | 0.27 | 10.7 | 3.8 | 3.5 |
| 24 | 20.1 | 43.7 | 3.7 | 0.19 | 13.9 | 8.45 | 6.34 |
| 25 | 30 | 58.3 | 7.5 | 0.38 | 10.7 | 2.47 | 3.49 |
| 26 | 30 | 41.7 | 5.4 | 0.27 | 14 | 8.36 | 6.68 |
| 27 | 30 | 29.2 | 3.8 | 0.19 | 13.9 | 8.77 | 6.93 |
| 28 | — | 0 | 4.7 | 0 | 14 | 11.3 | 11.79 |
| cntrl | — | 0 | 0 | 0 | 14 | 8.07 | 7.8 |

Figure 3:
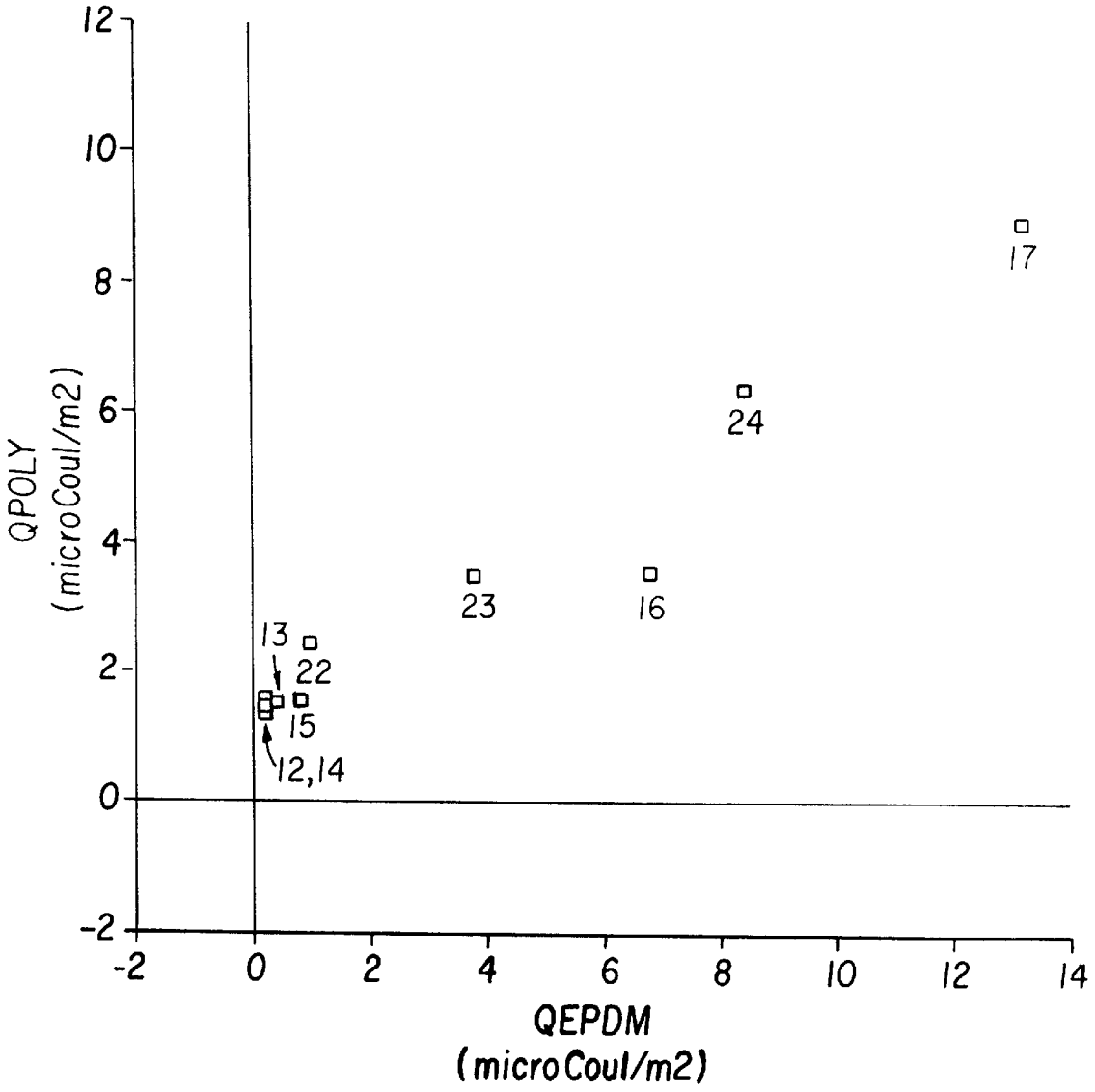
FIG. 3 shows the net charge density using a conductive rubber versus the net charge density using an insulating polyurethane for various overcoat layers.

As shown in FIGS. 2 and 3, the use of the electrically-conductive overcoat of this invention comprising an optimized combination of charge control agents and electronically-conductive acicular metal-containing particles provides for robust antistatic protection performance and minimizes triboelectric charging against both conductive and insulating roller materials, and ultimately, provides protection against static discharge and marking of the sensitized emulsion layer(s).

The invention has been described in detail with particular reference to certain preferred embodiments thereof, but it will be understood that variations and modifications can be effected within the spirit and scope of the invention.

What is claimed is:

1. A multilayer imaging element comprising:

a support;

one or more image-forming layers superposed on the support; and an outermost transparent electrically-conductive, non-charging, overcoat layer superposed on the support comprising colloidal, acicular electrically-conductive metal-containing particles, dispersed in a film-forming binder at a volume percentage of acicular conductive metal-containing particles of from 2 to 60, and a first charge control agent which imparts positive charging properties and a second charge control agent which imparts negative charging properties.

2. The multilayer imaging element of claim 1 wherein said acicular, electrically-conductive metal-containing fine particles are selected from the group consisting of antimony-doped tin oxide, tin-oxide doped indium sequioxide, aluminum-doped zinc oxide, niobium-doped titanium oxide, and oxygen-deficient titanium suboxide and titanium oxynitride.

3. The multilayer imaging element of claim 1, wherein said acicular, electrically-conductive metal-containing particles exhibit a packed powder specific resistivity of $10^3$ ohm·cm or less.

4. The multilayer imaging element of claim 1, wherein said acicular, electrically-conductive metal-containing particles are less than 0.05 μm in cross-sectional diameter and less than 1 μm in length.

5. The multilayer imaging element of claim 1, wherein said acicular, electrically-conductive metal-containing particles comprise a dry weight coverage of from 0.01 to 2 g/m$^2$.

6. The multilayer imaging element of claim 1, wherein said first charge control agent is selected from group (i) defined below;

(i) a positive charging anionic compound represented by the following formulas (1) and (2), $$R—(A)—SO_3M \quad (1)$$

where R represents an alkyl or alkenyl group or alkyl aryl group; A represents a single covalent bond or —O— or $—(OCH_2CH_2)_m—O_n—$, wherein m is an integer from 1 to 4 and n is zero or 1; and M represents an alkali metal cation;

(2)

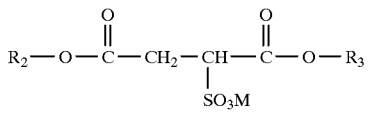

where $R_2$ and $R_3$ represent the same or different alkyl or alkyl-aryl groups; where M is a cation as defined above for formula (1).

7. The multilayer imaging element of claim 1, wherein said second charge control agent is selected from group (ii) defined below;

ii) a negative charging fluorine-containing anionic or nonionic compound having a fluoroalkyl or fluoroalkenyl group and a hydrophilic group, which is represented by the formulae (3), (4), (5) or (6)

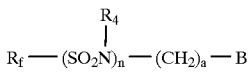

(3)

where $R_f$ represents a perfluorinated alkyl or alkenyl group having 6 to 12 carbon atoms; $R_4$ represents a methyl or ethyl group or a hydrogen atom; n has a value of 0 or 1; a has a value of 0, 1, 2 or 3, when n is zero or a value of 1, 2 or 3, when n is one: and B represents an anionic hydrophilic group; or a nonionic hydrophilic group;

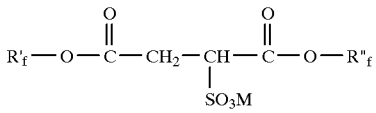

(4)

where $R'_f$ and $R''_f$ represent the same or different fluorinated alkyl group having 4 to 10 carbon atoms and at least 7 fluorine atoms, including 3 fluorine atoms on the end carbon atom; M represents an alkali metal cation;

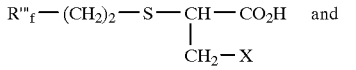

and (5)

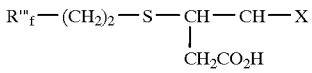

where $R'''_f$ represents a mixture of perfluorinated alkyl groups having 6, 8 and 10 carbon atoms, and X is —CONH $(CH_2)_3N(CH_3)_2$;

$$R_f—Y—D \quad (6)$$

where $R_f$ is defined in Formula (3), and Y is a nonionic hydrophilic group and D is —H or CH.

8. The multilayer imaging element of claim 1, wherein said film-forming binder comprises a water-soluble, hydrophilic polymer, a cellulose derivative, or a water-insoluble polymer.

9. The multilayer imaging element of claim 1, wherein said support comprises a poly(ethylene terephthalate) film, a poly(ethylene naphthalate) or a film cellulose acetate film.

10. The multilayer imaging element of claim 1, wherein said conductive non-charging overcoat layer directly overlies an image-forming layer.

11. The multilayer imaging element of claim 1, wherein said conductive non-charging overcoat layer directly overlies an intermediate layer overlying an image-forming layer.

12. The multilayer imaging element of claim 1, wherein said conductive non-charging overcoat layer is superposed on a side of the support opposite the one or more image-forming layers.

13. A photographic film comprising:

a support;

a silver halide emulsion layer superposed on a first or second side of said support;

an outermost transparent electrically-conductive, non-charging, overcoat layer superposed on the support comprising electronically-conductive, acicular, crystalline single-phase, antimony-doped tin oxide particles, said acicular conductive tin oxide particles having a cross-sectional diameter less than or equal to 0.02 $\mu$m and an aspect ratio of 5:1 or greater dispersed in a film-forming binder at a volume percentage of conductive metal-containing particles of from 2 to 60, and a first charge control agent which imparts positive charging properties and a second charge control agent which imparts negative charging properties.

14. A thermally-processable imaging element comprising:

a support;

an image-forming layer superposed on a first side of said support;

an outermost transparent electrically-conductive, non-charging, overcoat layer superposed on the support comprising electronically-conductive, acicular, crystalline single-phase, antimony-doped tin oxide particles, said acicular conductive tin oxide particles having a cross-sectional diameter less than or equal to 0.02 $\mu$m and an aspect ratio of 5:1 or greater dispersed in a film-forming binder at a volume percentage of conductive metal-containing particles of from 2 to 60, and a first charge control agent which imparts positive charging properties and a second charge control agent which imparts negative charging properties.

15. A photographic film comprising:

a support;

a silver halide emulsion layer superposed on a first side of said support;

a transparent magnetic recording layer superposed on a second side of said support; said transparent magnetic recording layer comprising ferromagnetic particles dispersed in a film-forming polymeric binder;

an outermost transparent electrically-conductive, non-charging, overcoat layer superposed on the support comprising electronically-conductive, acicular, crystalline single-phase, antimony-doped tin oxide particles, said acicular conductive tin oxide particles having a cross-sectional diameter less than or equal to 0.02 $\mu$m and an aspect ratio of 5:1 or greater dispersed in a film-forming binder at a volume percentage of conductive metal-containing particles of from 2 to 60, and a first charge control agent which imparts positive charging properties and a second charge control agent which imparts negative charging properties.

* * * * *